US007290373B2

(12) United States Patent
Austin et al.

(10) Patent No.: US 7,290,373 B2
(45) Date of Patent: Nov. 6, 2007

(54) EAVE RISER EXTENSION FOR ROOF TRANSITIONS

(75) Inventors: Kevin Austin, Encinitas, CA (US); Jerry Vandewater, Thousand Oaks, CA (US)

(73) Assignees: Boral Lifetile Inc., Roswell, GA (US); Monier Inc., Irvine, CA (US)

( * ) Notice: Subject to any disclaimer, the term of this patent is extended or adjusted under 35 U.S.C. 154(b) by 39 days.

(21) Appl. No.: 10/935,732

(22) Filed: Sep. 7, 2004

(65) Prior Publication Data

US 2005/0115171 A1 Jun. 2, 2005

Related U.S. Application Data

(63) Continuation of application No. 10/142,661, filed on May 10, 2002, now abandoned.

(60) Provisional application No. 60/290,415, filed on May 11, 2001.

(51) Int. Cl.
*E04B 7/00* (2006.01)

(52) U.S. Cl. ..... 52/95; 52/748.1; 52/58

(58) Field of Classification Search ..... 52/198, 52/199, 94, 95, 96, 97, 302.3, 748.1, 58, 52/287.1, 246; 454/365

See application file for complete search history.

(56) References Cited

U.S. PATENT DOCUMENTS

| | | | | |
|---|---|---|---|---|
| 4,418,505 | A * | 12/1983 | Thompson | 52/95 |
| 4,706,421 | A * | 11/1987 | Thompson | 52/94 |
| 6,415,559 | B1 * | 7/2002 | Reeves et al. | 52/94 |
| 6,595,849 | B2 * | 7/2003 | Miller | 454/365 |
| 2002/0178659 | A1 * | 12/2002 | Reeves et al. | 52/94 |

FOREIGN PATENT DOCUMENTS

EP 0395290 A1 * 10/1990

* cited by examiner

*Primary Examiner*—Jeanette Chapman
*Assistant Examiner*—Jessica Laux
(74) *Attorney, Agent, or Firm*—Alston & Bird LLP

(57) ABSTRACT

A roof transition system is provided for supporting and ventilating roof tiles near a roof transition such as a valley or a side wall. The system includes a corrugated flashing and an eave riser extension containing one or more openings for ventilation and drainage. The eave riser extension supports the lowermost row of roof tiles along the eaves at the pitch desired for the roof transition. The eave riser extension completes the closure of the entire eaves and provides support, ventilation, and drainage, while also providing a barrier to wind-driven precipitation, bird nesting, and animal invasion.

14 Claims, 4 Drawing Sheets

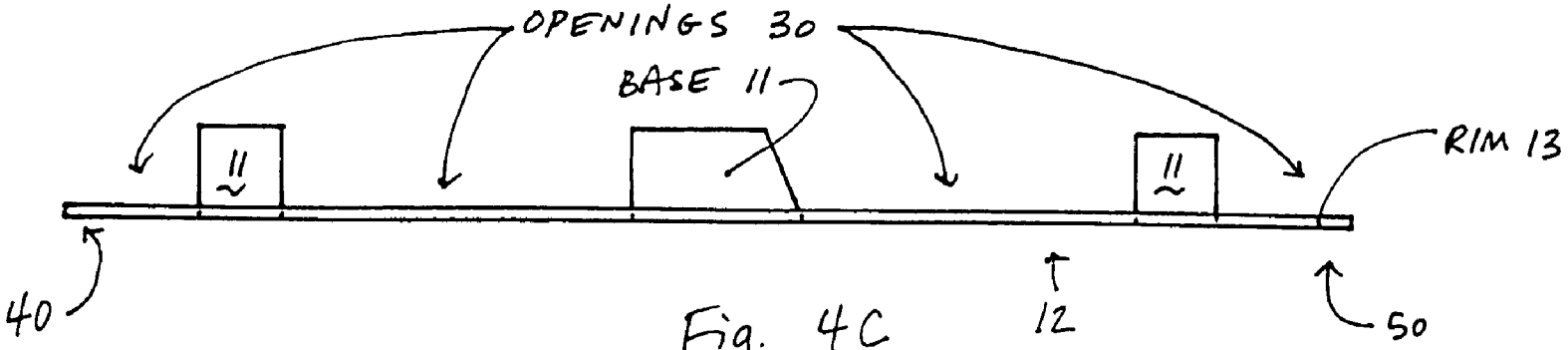
Fig. 4C
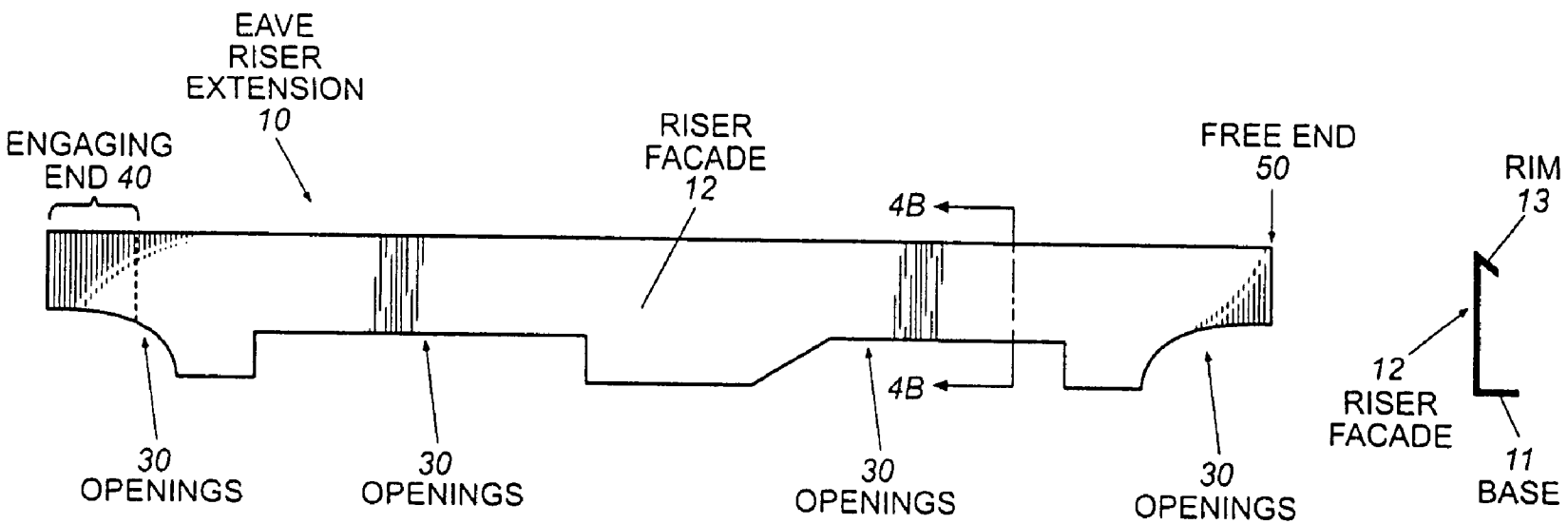
Fig. 4A
Fig. 4B

EAVE RISER EXTENSION FOR ROOF TRANSITIONS

CROSS-REFERENCE TO RELATED APPLICATIONS

The present application is a continuation of U.S. application Ser. No. 10/142,661 filed May 10, 2002, now abandoned which claims full priority to provisional patent Application No. 60/290,415 filed May 11, 2001, entitled "Eave Riser Extension for Roof Transitions". The present application claims the full benefit and priority of both of these application Ser. Nos. 10/142,661 and 60/290,415; and incorporates by reference the contents of each application.

FIELD OF THE INVENTION

The present invention relates generally to the field of roofing tile installation. More particularly, the invention provides a method and apparatus for providing drainage, ventilation, closure, and support to the roof tiles along the eaves at roof transitions such as valleys and side walls.

BACKGROUND OF THE INVENTION

The installation of a tile roof involves a variety of technical challenges and problems not encountered during the installation of a traditional shingle roof. Shingles are relatively thin and can be placed almost flat onto the roof decking in overlapping rows, but roofing tiles are thicker and do not tend to lie as flat when overlapping one another. Roofing tiles, therefore, require special installation methods and devices, particularly at roof transitions such as valleys and side walls.

In additional to flat tile, modern roof tiles are made in a variety of sizes and shapes to complement different architectural styles. For example, a traditional S-shaped tile might be used for Spanish style architecture, while a W-shaped tile might be used for a Mediterranean style project. The multitude of shapes available today increases the complexity of the technical challenges and problems when installing a tile roof.

A typical roof includes a solid plywood decking covered by a waterproof underlayment which is then covered by shingles or roof tiles. At roof transitions such as valleys and side walls, an additional device generally known as a flashing must be installed to collect the flow of water and direct it off the roof. A flashing is also installed at head walls, around chimneys, and around pipes and vents penetrating the roof. Because roof tiles, unlike shingles, do not tend to lay flat upon the flashing, specialized flashing styles have been designed to accommodate the peculiar needs of tile roofs.

For a valley transition, a typical flashing style currently in use for tile roofs is called valley flashing. Valley flashing features a series of built-in support ribs or corrugations to provide support for the roof tiles and to create defined troughs to channel water off the roof. Valley flashing resembles corrugated sheet metal.

For a side wall transition, a typical flashing style currently in use for tile roofs consists of a Z-bar and a side wall flashing (also called a tile pan or a wall tray). A Z-bar is a length of sheet metal that is z-shaped in cross section and designed to catch water flowing down the side wall and channel it into the side wall flashing. A side wall flashing is roughly L-shaped in cross section, but, like the valley flashing, it may contain one or more built-in support ribs or corrugations to channel water off the roof.

For roof transitions, generally, a flashing is used to cover the seam between the generally planar roof sections, to prevent leakage. A typical flashing includes corrugations positioned to channel water directly off the roof.

Generally, roof tiles rest upon one another in overlapping rows called courses. At the eaves of the roof, however, the lower edge of the tiles have no other tiles upon which to rest. So, for proper installation, the lowermost edge of the eaves course of tiles must be elevated above the roof decking to the proper angle or pitch. Supports known as eave risers are typically installed along the eaves to elevate the lowermost edge of the eaves course of roof tiles. An example of such an eave riser is disclosed in U.S. Pat. No. 4,418,505 issued to Thompson on Dec. 6, 1983.

Most eave riser designs include holes for drainage and ventilation. Adequate drainage and ventilation is critical to proper installation of a tile roof because the accumulation of water behind and under the tiles can lead to serious and expensive problems such as wood rot, structural failure, and roof leakage.

A typical eave riser is configured for installation along a generally straight eaves and atop a generally planar roof decking and waterproof underlayment. Although the roof decking and waterproof underlayment may be installed upon a pitched roof, it is generally smooth. A series of straight eave risers can be installed, end to end, along the eaves of the roof. At roof transitions such as valleys and side walls, however, the flashing changes the otherwise flat contour of the roof surface, especially when the flashing contains built-in support ribs or other corrugations. In the field, therefore, an installer may need to cut holes in a typical straight eave riser to accommodate the corrugations in a flashing at a roof transition. Such custom fitting in the field is expensive, time-consuming, and may often result in a significant loss of structural capacity at a critical roof transition.

Thus, there is a need for a method and apparatus for elevating and supporting the eaves course of tile at roof transitions where the valley flashing or side wall flashing includes support ribs or other corrugations. Such an apparatus should maintain sufficient drainage and ventilation at the roof transition. Such a method and apparatus should accomplish these goals in a reliable, durable, attractive, low-maintenance, and cost-effective manner.

SUMMARY OF THE INVENTION

The above and other needs are met by the present invention which, in one embodiment, provides a system for supporting and ventilating a tile roof along the eaves at a roof transition, such as a valley or a side wall, while facilitating drainage and promoting ventilation. Generally described, the present invention provides a roof transition system for a tile roof. The tile roof is characterized by a generally planar roof surface, a plurality of roof tiles, and a plurality of straight eave risers positioned along the eaves. The roof transition system includes a flashing disposed atop the roof transition and an eave riser extension disposed atop the flashing. The eave riser extension has sufficient height to support the roof tiles at a desired pitch and has one or more openings that are sized and shaped to permit ventilation and drainage.

In another aspect of the system, the eave riser extension is generally L-shaped in cross section, having a base positioned along the generally planar roof surface and a riser facade to support the roof tiles. In one embodiment, the eave riser extension also includes a rim along the top of the riser facade.

In another aspect of the roof transition system, the roof transition defines a vertical transition plane, and the eave riser extension is of sufficient length to span the distance between the transition plane and a nearest open end of one of the straight eave risers. In this aspect, the eave riser extension has an engaging end for connecting to the straight eave riser and a free end that is positioned in or near the transition plane of the roof transition. Where the flashing includes one or more corrugations, the openings through the eave riser extension are further sized and shaped to coincide with and span the width of the corrugations.

In another aspect, the present invention, in one embodiment, provides an apparatus for supporting and ventilating a tile roof along the eaves at a roof transition. Generally described, the present invention comprises an eave riser extension having a base and a riser facade. The riser facade is connected to the base along the length of the eave riser extension. The riser facade has sufficient height to support the roof tiles at a desired pitch, and may include a rim along its top edge. The riser facade has one or more openings that are sized and shaped to facilitate ventilation and drainage. The base may includes openings as well. Where the flashing includes one or more corrugations, the openings through the eave riser extension are further sized and shaped to coincide with and span the width of the corrugations.

In one aspect of the apparatus, the eave riser extension spans the distance between the transition plane and a nearest open end of one of the straight eave risers. In this aspect, the eave riser extension has an engaging end that is sized and shaped to connect to the straight eave riser.

In another aspect, the present invention, in one embodiment, provides a method for providing ventilation and closure to the eaves of a tile roof at a roof transition. Generally described, the method present invention comprises the steps of installing a flashing atop the roof transition, positioning an eave riser extension atop the flashing, and laying the roof tiles atop the eave riser extension at the desired pitch. The eave riser extension has a plurality of openings to facilitate ventilation and drainage, and is long enough to span the distance from the nearest open end of one of the straight eave risers to the transition plane.

In another aspect of the method, the engaging end of the eave riser extension is connected to the open end of the nearest straight eave riser to provide closure to the tile roof. Where the flashing includes one or more corrugations, the method may include sizing and shaping the openings through the eave riser extension to coincide with and span the width of the corrugations.

In another aspect, the present invention, in one embodiment, provides a method of fabricating an eave riser extension for supporting and ventilating a tile roof at a roof transition. The method comprises the steps of selecting a sheet of material having sufficient strength to support the roof tiles and sufficient ductility to withstand bending, treating the sheet to improve its resistance to corrosion in the expected use environment, and cutting a portion from the sheet according to a pattern. The pattern is sized and shaped to encompass all parts of the eave riser extension. The portion cut from the sheet has one, uninterrupted, linear edge along its length. The method further includes the step of bending a base segment from the side opposing the linear edge, according to the pattern, until the base segment is approximately perpendicular to the remaining portion. In one embodiment, the method further includes the step of bending a rim segment lengthwise along the linear edge, toward the base segment, according to the pattern, until the rim segment forms an acute angle with the remaining portion.

It is a principal object of the present invention to provide a roof transition system to support the first course of roof tiles on a supporting roof structure along the eaves at a desired pitch near a roof transition such as a valley or side wall.

It is a further object of this invention to facilitate the circulation of air underneath the roof tiles. It is a related object of this invention to optimize the heat transfer between the roof tiles and the structure.

It is another object of this invention to facilitate the shedding of water off the roof from underneath the roof tiles at a roof transition without any appreciable damming or ponding. It is a related object of this invention to channel water along the flashing beneath the tiles and direct it away from the eaves of the roof.

It is yet another object of the present invention to provide an eave riser extension for use at a variety of roof transitions having different sizes and shapes. It is a related object of the present invention to provide an eave riser extension to accommodate corrugated flashings without compromising ventilation or drainage.

It is further an object of the present invention to provide an eave riser extension configured for easy field assembly to existing straight eave risers, thereby completing an eave riser that spans the entire width of the eaves course of roof tile to be supported.

It is another object of the present invention to provide a roof transition system and an eave riser extension that prevents the infiltration of wind-driven precipitation.

It is another object of the present invention to provide a roof transition system and an eave riser extension that inhibits bird nesting and other animal invasion through the eaves.

These and other objects are accomplished by the method and apparatus disclosed and will become apparent from the following detailed description of a preferred embodiment in conjunction with the accompanying drawings in which like numerals designate like elements.

BRIEF DESCRIPTION OF THE DRAWINGS

FIG. 4A is a front view of an eave riser extension, configured for use at a side wall roof transition, according to an embodiment of the present invention.

FIG. 4B is a side view of an eave riser extension, configured for use at a side wall roof transition, according to an embodiment of the present invention.

FIG. 4C is a top view of an eave riser extension, configured for use at a side wall roof transition, according to an embodiment of the present invention.

DETAILED DESCRIPTION OF THE INVENTION

Reference is now made to the figures, in which like elements indicate like elements throughout the several views.

Figure 1:
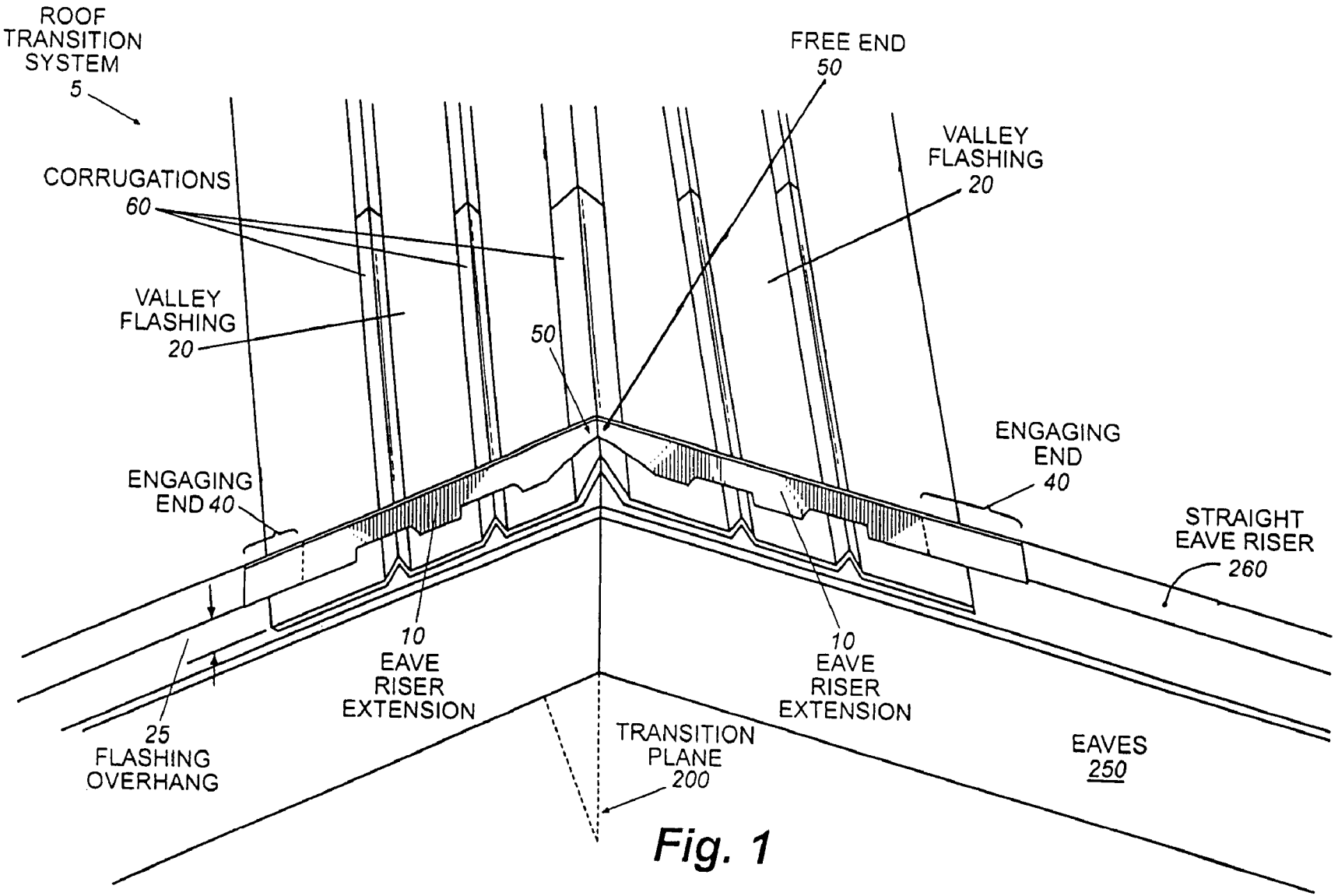
FIG. 1 is a perspective view of a roof transition system according to an embodiment of the present invention, configured for use at a roof valley transition.

FIG. 1 is a perspective view of the inventive roof transition system 5, as installed, relative to the eaves 250 of a roof structure. The roof transition system 5 generally includes a flashing 20 and an eave riser extension 10. The eave riser extension 10 includes a plurality of openings 30 for ventilation and drainage.

Figure 3:
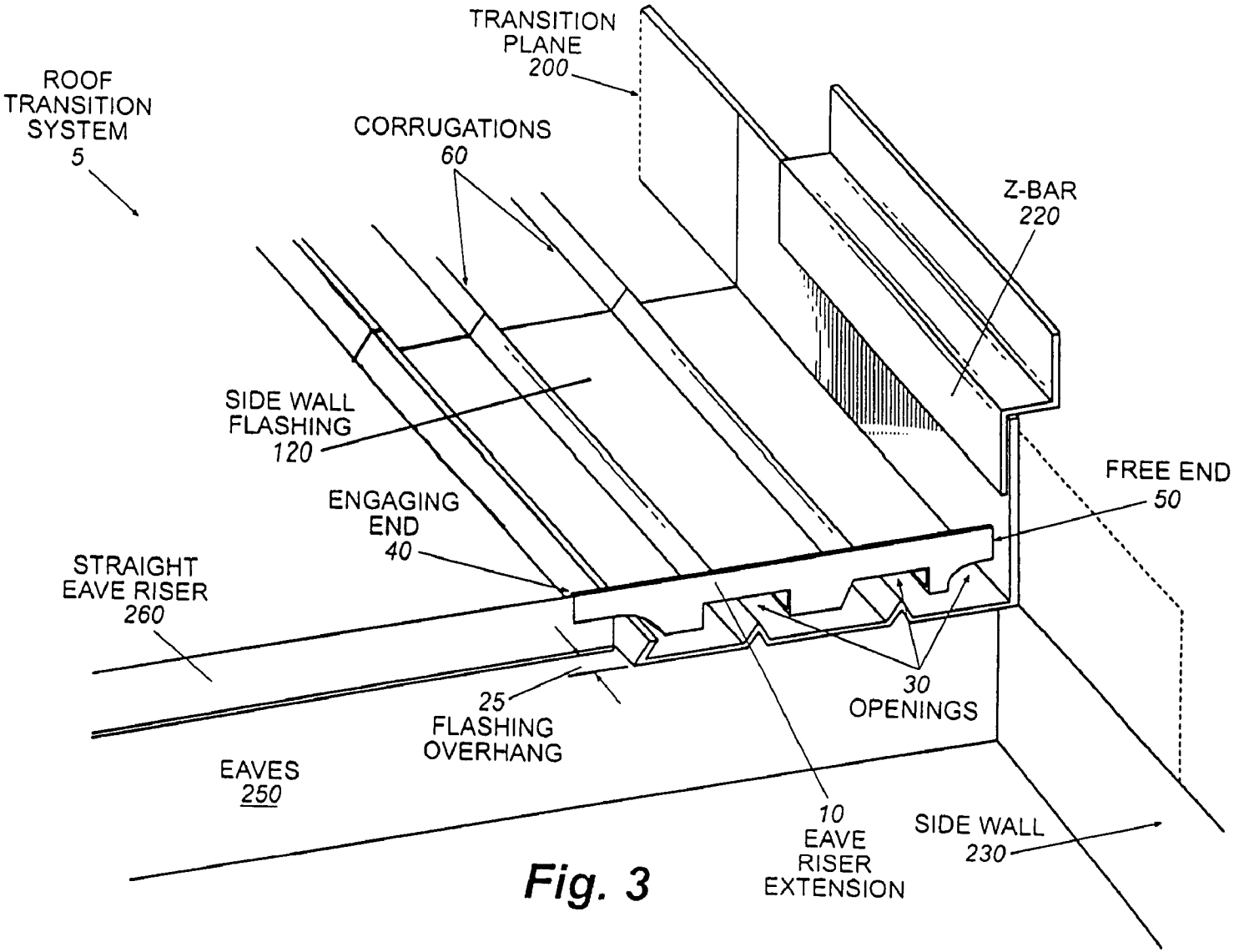
FIG. 3 is a perspective view of a roof transition system according to an embodiment of the present invention, configured for use at a side wall roof transition.

A roof transition occurs at the intersection of two or more differently-oriented roof sections. For example, a valley transition is formed on the roof of an L-shaped structure where the two generally planar roof sections meet. A side wall transition is formed where the roof of a structure meets the vertical wall of an adjacent structure that is higher. The roof transition is defined by the line or seam that is formed along the intersection of the adjacent roof sections. A vertically-oriented, two-dimensional plane that passes through the roof transition is called the transition plane 200, as shown in FIGS. 1 and 3.

Valley Transitions

The roof transition system 5 shown in FIG. 1 includes an eave riser extension 10 on each side of a roof transition called a valley. The eave riser extensions 10 support the lower edge of the first course of roof tiles along the eaves 250 at a desired pitch. A vertical plane passing through the center of the valley is called the transition plane 200.

In one aspect of the invention, depicted in FIG. 1, the eave riser extension 10 is installed on top of the flashing 20 such that the openings 30 are located directly over the corrugations 60, thereby allowing the flow of water along the flashing 20 to pass through the openings 30 unimpeded. Preferably, the flashing 20 extends beyond the plane of the eaves 250, creating a flashing overhang 25 to direct the water beyond the eaves 250.

Figure 2C:
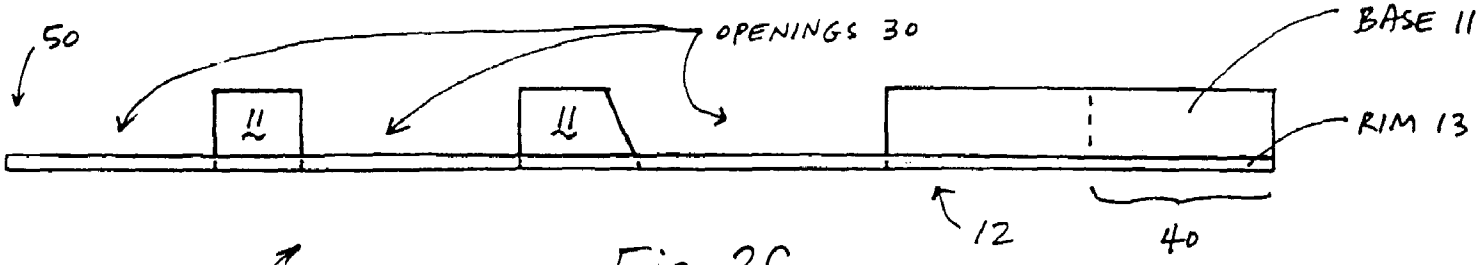
FIG. 2C is a top view of an eave riser extension, configured for use at a roof valley transition, according to an embodiment of the present invention.
Figure 2B:
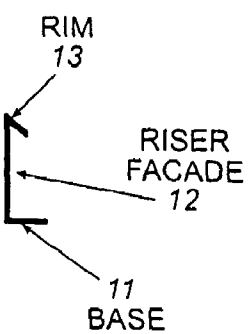
FIG. 2B is a side view of an eave riser extension, configured for use at a roof valley transition, according to an embodiment of the present invention.
Figure 2A:
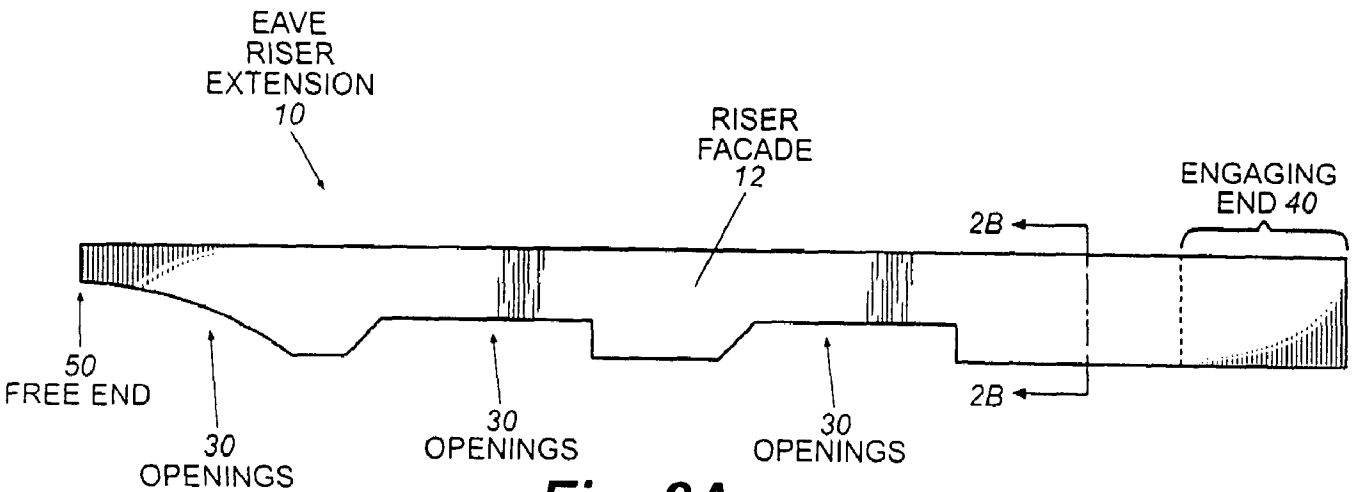
FIG. 2A is a front view of an eave riser extension, configured for use at a roof valley transition, according to an embodiment of the present invention.

In another aspect of the invention, as shown in FIG. 2B, the eave riser extension 10 may include a base 11 and a riser facade 12. The base 11 and riser facade 12 are disposed in planar contact with one another. As such, the eave riser extension 10 is generally L-shaped in cross section. The openings 30, shown in FIG. 2A, may take any shape that provides sufficient ventilation and drainage and accommodates passage of the corrugations 60 or other features of the flashing 20. The openings 30 may penetrate both the riser facade 12 and the base 11, as shown in FIG. 2C, or the riser facade 12 alone. In a preferred embodiment, the openings 30 penetrate both the riser facade 12 and the base 11.

The base 11 of the eave riser extension 10 may be installed along the roof structure, with the riser facade 12 extending generally upward from the base 11. The riser facade 12 may be perpendicular to the base 11 or, alternatively, may be vertical, as long as the riser facade 12 has sufficient height to support the first row of roof tiles at a desired pitch. The eave riser extension 10 may also include a rim 13, as shown in FIG. 2B, located along the top of the riser facade 12 for added strength and stability. The rim 13 and riser facade 12 are disposed in planar contact with one another. In the embodiment shown, the rim 13 extends rearward from the top edge of the riser facade 12 and extends downward at an angle toward the base 11 of the eave riser extension 10; however, this is not the only suitable configuration. The rim 13 extend forward, along the lowermost surface of the roof tiles. The rim 13 may also extend in a direction that is generally perpendicular to the riser facade 12. Other rim configurations are contemplated that will provide strength and stability to the eave riser extension 10.

When installed, the roof tiles in a preferred embodiment simply rest atop the uppermost edge of the riser facade 12 of eave riser extension 10 without requiring an attachment. Certain applications, however, may require an attachment between one or more tiles and the eave riser extension 10.

The eave riser extension 10 may be made of any suitable material for the expected outdoor environment. Corrosion resistance, long life, and general durability are some of the features desired for such tile roof support installations. In one embodiment, the eave riser extension 10 is formed of galvanized aluminum or steel having a baked-on enamel coating. The eave riser extension 10 may be made from a solid sheet of material or, alternatively, may be made from a sheet of rigid screen or mesh of sufficient strength to support the expected load of the roof tiles.

Preferably, the eave riser extension 10 is formed from a single piece of material that is capable of being bent into the desired configuration while maintaining its strength. In this aspect, one embodiment of the eave riser extension 10, as shown in FIG. 2B, may be constructed by bending the riser facade 12 until it is approximately perpendicular to the base 11. The rim 13 may be bent rearward toward the base 11 until it forms an angle of about forty-five degrees with the riser facade 12. The openings 30 may be cut from the material before or after bending.

Referring again to FIG. 1, in a preferred embodiment, the flashing 20 includes corrugations 60 that are generally parallel to the natural flow of water off the roof. These corrugations 60 provide structure to the flashing 20 and a channel for the water flow. Preferably, the openings 30 in the eave riser extensions 10 coincide with and span the distance across the corrugations 60, but are somewhat larger than the corrugations 60, so as to provide an opening.

In general, supports referred to as straight eave risers 260 are installed along the eaves 250 of a generally straight roof edge and atop a generally planar roof decking. Straight eave risers 260 generally include at least a base, a riser facade, and an upper rim for stability. In another aspect of the invention, the eave riser extension 10 is dimensioned similarly to an end portion of the straight eave riser 260 such that an engaging end 40 of the eave riser extension 10 can be connected to the open end of the nearest straight eave riser 260. The free end 50 rests at or near the transition plane 200. In a preferred embodiment, the engaging end 40 is dimensioned to receive by insertion a portion of the open end of one of the straight eave risers 260. Preferably, the joining of the two risers 10, 260 can be accomplished in the field without tools. The free end 50 of the eave riser extension 10 may or may not be attached to one or more elements lying within or near the transition plane 200.

In one embodiment, configured for a valley transition, the free end 50 of the eave riser extension 10 terminates at the transition plane 200, which lies through the center of the valley. Because a roof valley, by definition, involves the meeting of two roof surfaces, another eave riser extension 10 may be needed on the opposing side of the valley. In similar fashion, the free end 50 of the opposing eave riser extension 10 terminates at the transition plane 200 located through the center of the valley. In this embodiment, shown in FIG. 1, the free ends 50 meet one another at the center of the valley. Preferably, the openings 30, if any, nearest the free ends 50 of the eave riser extensions 10 may have curved boundaries which meet in the transition plane 200 to provide sufficient ventilation and drainage and to accommodate structural features that may be present within or near the transition plane 200.

Side Wall Transitions

The roof transition system 5 shown in FIG. 3 includes an eave riser extension 10, in one embodiment, installed at a roof transition called a side wall. The eave riser extensions 10 support the lower edge of the first course of roof tiles along the eaves 250 at a desired pitch. The transition plane 200 at a sidewall transition is a vertical plane defined by the surface of the side wall 230 or the side wall flashing 120.

For a side wall transition such as the one depicted in FIG. 3, a typical flashing currently in use on tile roofs consists of a Z-bar 220 and a side wall flashing 120 (also called a wall tray or a tile pan). The Z-bar 220 is a length of sheet metal that is z-shaped in cross section and designed to catch water flowing down the side wall and channel it into the side wall flashing. A side wall flashing 120 is roughly L-shaped in cross section; however, like the corrugated valley flashing 20, the side wall flashing 120 may contain one or more built-in support ribs or corrugations 60 to channel water off the roof. In another similarity, the side wall flashing 120 extends beyond the plane of the eaves 250, creating an overhang 25 to direct the water beyond the eaves 250.

In one aspect of the invention, depicted in FIG. 3, the eave riser extension 10 is installed on top of the flashing 20 such that the openings 30 are located directly over the corrugations 60, thereby allowing the flow of water along the flashing 20 to pass through the openings 30 unimpeded.

In another aspect of the invention, as shown in FIG. 4B, the eave riser extension 10 may include a base 11 and a riser facade 12. The base 11 and riser facade 12 are disposed in planar contact with one another. The openings 30, shown in FIG. 4A, may take any shape that provides sufficient ventilation and drainage and accommodates passage of the corrugations 60 or other features of the flashing 20. The openings 30 may penetrate both the riser facade 12 and the base 11, as shown in FIG. 4C, or the riser facade 12 alone. In a preferred embodiment, the openings 30 penetrate both the riser facade 12 and the base 11.

The base 11 of the eave riser extension 10 may be installed along the roof structure, with the riser facade 12 extending generally upward from the base 11. The riser facade 12 may be perpendicular to the base 11 or, alternatively, may be vertical, as long as the riser facade 12 has sufficient height to support the first row of roof tiles at a desired pitch. The eave riser extension 10 may also include a rim 13, as shown in FIG. 4B, located along the top of the riser facade 12 for added strength and stability. The rim 13 and riser facade 12 are disposed in planar contact with one another. In the embodiment shown, the rim 13 extends rearward from the top edge of the riser facade 12 and extends downward at an angle toward the base 11 of the eave riser extension 10; however, this is not the only suitable configuration. The rim 13 extends forward, along the lowermost surface of the roof tiles. The rim 13 may also extend in a direction that is generally perpendicular to the riser facade 12. Other rim configurations are contemplated that will provide strength and stability to the eave riser extension 10.

When installed, the roof tiles in a preferred embodiment simply rest atop the uppermost edge of the riser facade 12 of eave riser extension 10 without requiring an attachment. Certain applications, however, may require an attachment between one or more tiles and the eave riser extension 10.

The eave riser extension 10 may be made of any suitable material for the expected outdoor environment. Corrosion resistance, long life, and general durability are some of the features desired for such tile roof support installations. In one embodiment, the eave riser extension 10 is formed of galvanized aluminum or steel having a baked-on enamel coating. The eave riser extension 10 may be made from a solid sheet of material or, alternatively, may be made from a sheet of rigid screen or mesh of sufficient strength to support the expected load of the roof tiles.

Preferably, the eave riser extension 10 is formed from a single piece of material that is capable of being bent into the desired configuration while maintaining its strength. In this aspect, one embodiment of the eave riser extension 10, as shown in FIG. 4B, may be constructed by bending the riser facade 12 until it is approximately perpendicular to the base 11. The rim 13 may be bent rearward toward the base 11 until it forms an angle of about forty-five degrees with the riser facade 12. The openings 30 may be cut from the material before or after bending.

Referring again to FIG. 3, in a preferred embodiment, the flashing 20 includes corrugations 60 that are generally parallel to the natural flow of water off the roof. These corrugations 60 provide structure to the flashing 20 and a channel for the water flow. Preferably, the openings 30 in the eave riser extensions 10 coincide with and span the distance across the corrugations 60, but are somewhat larger than the corrugations 60, so as to provide an opening.

In general, supports referred to as straight eave risers 260 are installed along the eaves 250 of a generally straight roof edge and atop a generally planar roof decking. Straight eave risers 260 generally include at least a base, a riser facade, and an upper rim for stability.

In another aspect of the invention, the eave riser extension 10 is dimensioned similarly to an end portion of the straight eave riser 260 such that an engaging end 40 of the eave riser extension 10 can be connected to the open end of the nearest straight eave riser 260. The free end 50 rests at or near the transition plane 200. Preferably, the joining of the two risers 10, 260 can be accomplished in the field without tools. The free end 50 of the eave riser extension 10 may or may not be attached to one or more elements lying within or near the transition plane 200.

In one embodiment, configured for a side wall transition as shown in FIG. 3, the free end 50 of the eave riser extension 10 terminates at the transition plane 200, where the side wall flashing 120 is roughly perpendicular to the eaves 250. Preferably, the opening 30 nearest the free end 50 of the eave riser extension 10 has a curved boundary to allow for ventilation and drainage, and to accommodate structural features that may be present within the transition plane 200.

The eave riser extension 10 of the present invention may be configured for use at valley transitions, side wall transitions, or at a variety of other roof transitions.

Ventilation Method

In another aspect, the present invention generally provides a method for closing and ventilating the lowermost row of roof tiles along the eaves 250 at a roof transition. In one aspect of the method, a flashing 20 is connected to the roof surface at a transition. An eave riser extension 10 having a base 11 and a riser facade 12 is positioned on top of the flashing 20 such that the riser facade 12 extends upward from the base 11. The first course of roof tiles is laid along the eaves 250 such that the roof tiles rest upon the top of the eave riser extension 10 at a desired pitch. Certain applications may require an attachment between one or more tiles and the eave riser extension 10.

In another aspect of the method, in an embodiment wherein the eave riser extension 10 includes an engaging end 40 and a free end 50, the engaging end 40 may be joined to a portion of an open end of the straight eave risers 260 already installed along the eaves 250. Preferably, the engaging end 40 may be joined to an adjacent straight eave riser 260 without tools or fasteners. The free end 50 may or may not be joined to any particular element where it terminates at or near the roof transition plane 200.

It will be appreciated that the present invention provides a roof transition system 5 to support the first course of roof tiles on a supporting roof structure along the eaves 250 at a desired pitch near a roof transition such as a valley or side wall. Water flows across the top of the valley flashing 20 or side wall flashing 120 and flows freely through openings 30 in the eave riser extension 10 without any appreciable damming or ponding. Water flow is facilitated by one or more corrugations 60 and by an overhang 25. Air circulates underneath the roof tiles along the eaves 250 and throughout the roof structure, resulting in reduced heat transfer from the roof tiles into the attic space. The eave riser extension 10 blocks wind-driven precipitation, inhibits bird nesting, and prevents the invasion of animals into and through the eaves 250 at roof transitions.

It will also be appreciated that the present invention provides a ventilated eave riser extension 10 for use at a variety of roof transitions having different sizes, shapes, and angles. Moreover, the eave riser extension 10 is configured for easy field assembly to the end of a straight eave riser 260, thereby accomplishing the completion of an eave riser that spans the entire length of the eaves course of roof tile.

Method of Fabrication

The eave riser extension 10 may be formed from a single piece of material that is capable of withstanding the forces of bending while maintaining its strength. The eave riser extension 10 may begin as a solid sheet of metal or, alternatively, as a sheet of rigid screen or mesh having sufficient ductility and strength.

In one embodiment, the method of fabrication begins with treating the selected sheet of material to improve its corrosion resistance. Such treatments include galvanizing, coating, painting, and other methods of protecting the material without compromising its strength. The fabrication includes cutting a portion from the sheet according to a pattern. The pattern is sized and shaped to encompass all parts of the eave riser extension, including the base, the riser facade, the rim if provided, and all the openings. The portion cut from the sheet has one, uninterrupted, linear edge along its length, which forms the top edge of the riser facade or the rim, if one is provided. The method further includes the step of bending a base segment from the side opposing the linear edge, according to the pattern, until the base segment is approximately perpendicular to the remaining portion (which forms the riser facade). In one embodiment, the method further includes the step of bending a rim segment lengthwise along the linear edge, toward the base segment, according to the pattern, until the rim segment forms an acute angle with the remaining portion.

Although the invention has been described in terms of a preferred embodiment, it will be appreciated by those skilled in the art that additions, substitutions, modifications, and deletions not specifically described may be made without departing from the spirit and scope of the invention as defined in the claims.

The invention claimed is:

1. A method for providing ventilation and closure to an eaves of a tile roof at a roof transition, wherein the roof transition defines a vertical transition plane, and the tile roof is characterized by a roof surface, an eaves, a plurality of roof tiles, and a plurality of straight eave risers positioned along said eaves, said method comprising:

installing a flashing atop said roof transition, said flashing being characterized by one or more corrugations;

positioning an eave riser extension atop said flashing, said eave riser extension being generally L-shaped in cross section, and having a base positioned along said roof surface and a riser facade to support said roof tiles, said base and said riser facade defining one or more intermediate openings therethrough and having sufficient length to substantially extend between a free end of the nearest of said straight eave risers and said transition plane;

sizing and shaping one or more of said openings to span one or more of said corrugations; and laying one or more of said roof tiles atop said eave riser extension at a desired pitch.

2. The method of claim 1 wherein the one or more openings are further configured to permit ventilation and drainage between said flashing and said eave riser extension.

3. The method of claim 1 wherein said step of positioning said eave riser extension atop said flashing comprises positioning said base adjacent said flashing such that said riser facade extends upwardly from said flashing.

4. The method of claim 3 wherein the eave riser extension further comprises a rim disposed at least in part in planar contact with a top edge of said riser facade.

5. The method of claim 3 wherein said eave riser extension defines a free end for positioning adjacent said transition plane, said free end being defined by an arcuate-shaped portion of said riser facade and an opening in said base.

6. The method of claim 1 wherein the step of positioning said eave riser extension atop said flashing comprises positioning an engaging end of said cave riser extension adjacent to said free end of said straight eave riser such that a free end of said eave riser extension is positioned adjacent said transition plane.

7. A roof transition system for a tile roof, the tile roof characterized by a roof surface, an eave, a plurality of roof tiles, and a plurality of straight eave risers positioned along the eave, said roof transition system comprising:

a flashing having one or more corrugations disposed atop a roof transition, said roof transition defining a vertical transition plane; and an eave riser extension disposed atop said flashing and having sufficient height to support a plurality of said roof tiles at a desired pitch, said eave riser extension being generally L-shaped in cross section, having a base positioned along said roof surface and a riser facade extending substantially upwardly from said roof surface to support said roof tiles, said base and said riser facade further defining one or more intermediate openings therethrough, each of said one or more intermediate openings sized and shaped to permit ventilation and drainage and substantially span each of said one or more corrugations, wherein said cave riser extension is of sufficient length to extend substantially between said transition plane and a free end of the nearest of said straight eave risers, and wherein said cave riser extension further comprises an engaging end and a free end, said engaging end being sized and shaped to engage said free end of said straight eave riser and said free end of said eave riser extension defining an end opening, said end opening adapted for being positioned adjacent said transition plane and sized and shaped to permit ventilation and drainage.

8. The roof transition system of claim 7, wherein said openings are configured to permit ventilation and drainage between said flashing and said eave riser extension.

9. The roof transition system of claim 7, wherein said eave riser extension further comprises a rim disposed at least in part in planar contact with a top edge of said riser facade.

10. The roof transition system of claim 7, wherein said flashing extends beyond said eaves.

11. An eave riser extension for supporting and ventilating a tile roof at a roof transition, wherein the roof transition defines a vertical transition plane, the tile roof characterized by a roof surface, an eaves, a plurality of roof tiles, and a plurality of straight eave risers positioned along the eaves, said eave riser extension comprising:

a base adapted for being disposed atop flashing, said flashing being characterized by one or more corrugations; and a riser facade disposed at least in part in planar contact with said base, having sufficient height to support a plurality of roof tiles at a desired pitch, said base and riser facade forming a generally L-shaped cross section, wherein said base and said riser facade define one or more intermediate openings therethrough, each of said one or more intermediate openings sized and shaped to permit ventilation and drainage and to substantially span each of said one or more corrugations;

wherein said eave riser extension is adapted to extend between said transition plane and a free end of a nearest straight eave riser, and wherein said eave riser extension comprises a free end that defines an end opening, said end opening of said free end of said eave riser extension adapted to be positioned adjacent said transition plane.

12. The cave riser extension of claim 11, comprising an engaging end, wherein said engaging end is sized and shaped to engage said free end of said nearest of said straight eave risers.

13. The cave riser extension of claim 11, further comprising a rim disposed at least in part in planar contact with a top edge of said riser facade.

14. A method for providing ventilation and closure to an eaves of a tile roof at a roof transition, wherein the roof transition defines a vertical transition plane, and the tile roof is characterized by a roof surface, an eaves, a plurality of roof tiles, and a plurality of straight eave risers positioned along said eaves, said method comprising:

installing a flashing atop said roof transition, said flashing characterized by one or more raised portions;

positioning an eave riser extension atop said flashing, said eave riser extension being generally L-shaped in cross section, and having a base positioned along said roof surface and a riser facade to support said roof tiles, said base and said riser facade further defining one or more intermediate openings therethrough and having sufficient length to substantially extend between a free end of the nearest of said straight eave risers and said transition plane, said eave riser extension including a free end that defines an end opening; and laying one or more of said roof tiles atop said eave riser extension at a desired pitch;

wherein said end opening of said free end of said eave riser extension is sized and shaped to be positioned adjacent said transition plane and wherein each of said one or more intermediate openings are sized and shaped to substantially span each of said one or more raised portions.

* * * * *

UNITED STATES PATENT AND TRADEMARK OFFICE

CERTIFICATE OF CORRECTION

PATENT NO. : 7,290,373 B2
APPLICATION NO. : 10/935732
DATED : November 6, 2007
INVENTOR(S) : Austin et al.

It is certified that error appears in the above-identified patent and that said Letters Patent is hereby corrected as shown below:

Column 3,
Lines 1, 3, 19, 21, 23, each occurrence, “facade” should read --façade--.

Column 5,
Lines 47, 54, 55, 56, 58, 60, 61, 65, 66 , each occurrence, “facade” should read --façade--.

Column 6,
Lines 7, 11, 30, 33, 46, each occurrence, “facade” should read --façade--.

Column 7,
Lines 39, 44, 45, 47, 49, 51, 52, 56, 57, 59, 65, each occurrence, “facade” should read --façade--.

Column 8,
Lines 2, 21, 24, 37, each occurrence, “facade” should read --façade--.

Column 9,
Lines 1, 2, 55, 58, 63, each occurrence, “facade” should read --façade--.

Column 10,
Lines 19, 20, 35, 38, 42, 61, 63, each occurrence, “facade” should read --façade--;
Line 45, “cave” should read --eave--.

Column 11,
Lines 1 and 4, “cave” should read --eave--;
Lines 16, 28, 31, 33, each occurrence, “facade” should read --façade--.

UNITED STATES PATENT AND TRADEMARK OFFICE

CERTIFICATE OF CORRECTION

PATENT NO. : 7,290,373 B2
APPLICATION NO. : 10/935732
DATED : November 6, 2007
INVENTOR(S) : Austin et al.

It is certified that error appears in the above-identified patent and that said Letters Patent is hereby corrected as shown below:

Column 12,
Lines 5 and 9, "cave" should read --eave--;
Lines 11, 23, 24, each occurrence, "facade" should read --façade--.

Signed and Sealed this

Twenty-ninth Day of April, 2008

JON W. DUDAS
*Director of the United States Patent and Trademark Office*